United States Patent [19]

Takise

[11] Patent Number: 4,570,742

[45] Date of Patent: Feb. 18, 1986

[54] MICROPHONE APPARATUS

[75] Inventor: Tadashi Takise, Chiba, Japan

[73] Assignee: Sony Corporation, Tokyo, Japan

[21] Appl. No.: 531,541

[22] Filed: Sep. 9, 1983

[30] Foreign Application Priority Data

Sep. 27, 1982 [JP] Japan ..... 57-167998

[51] Int. Cl.[3] ..... G10K 11/00

[52] U.S. Cl. ..... 181/175; 181/129; 381/26

[58] Field of Search ..... 181/166, 158, 171, 175; 175/146 R, 121 D; 381/26, 91, 92, 97, 71; 179/121 R

[56] References Cited

U.S. PATENT DOCUMENTS 2,457,527 12/1948 Bruce ..... 181/175

4,314,098 2/1982 Maerfeld ..... 181/175 X

OTHER PUBLICATIONS

L. J. Sivian et al., "On Sound Diffraction Caused by Rigid Circular Plate, Square Plate and Semi-Infinite Screen", Journal of the Acoustical Society, Apr. 1932, pp. 483–510.

Takise et al., "The Acoustical Behavior of a Microphone Placed Adjacent to a Rigid Boundary and its Applications to Microphone Systems", Journal of the Acoustical Society of Japan, vol. 40, 3, published Mar. 1984, pp. 135–145.

*Primary Examiner*—Benjamin R. Fuller

*Attorney, Agent, or Firm*—Hill, Van Santen, Steadman & Simpson

[57] ABSTRACT

A microphone apparatus is disclosed which consists of a plain plate with a constant area and a microphone element located on the plain plate at its peripheral position at least different from the center thereof.

6 Claims, 14 Drawing Figures

MICROPHONE APPARATUS

BACKGROUND OF THE INVENTION

1. Field of the Invention

The present invention relates generally to a microphone apparatus, and is directed more particularly to a microphone apparatus suitable for use upon collecting sound by utilizing a sound field near the surface of a rigid body plain plate and so on.

2. Description of the Prior Art

Recently, such a sound collecting method for utilizing the sound field near the surface of a rigid body plain plate becomes a topic in the art. In case of employing such sound collecting method, it is necessary to clearly grasp the relation among the setting state, frequency characteristic, directivity at a sound receiving point and so on. As to the sound field near the surface of a rigid body plain plate analysises and experiments have been carried out in various view points by many researchers from the end of the 19th century. In order to perform severe analysis of such sound field, it is necessary to consider the diffraction of sound through one side of the surface of a rigid body plain plate to its back or rear side. However, when such severe analysis is performed, complicated calculations must be achieved. Therefore, in the prior art satisfactory results are not always obtained and hence the prior art sound collecting method utilizing the sound field near the surface of the rigid body plain plate is lacking in practice and it is difficult to provide a desired microphone apparatus for practising such sound collecting method.

OBJECTS AND SUMMARY OF THE INVENTION

Accordingly, it is an object of the present invention to provide a microphone apparatus suitable to practise a sound collecting system which can effectively utilize the sound field near the surface of a rigid body plain plate.

According to an aspect of the present invention there is provided a microphone apparatus which comprises:

a plain plate with a constant area; and a microphone element located on the plain plate at a peripheral position at least different from a center of said plain plate.

The other objects, features and advantages of the present invention will become apparent from the following description take in conjunction with the accompanying drawings through which the like references designate the same elements and parts.

DESCRIPTION OF THE PREFERRED EMBODIMENTS

The present invention will be hereinafter described with reference to the attached drawings.

At first, the fundamental theory of the present invention will be now described with reference to FIGS. 1 and 2.

Figure 1:
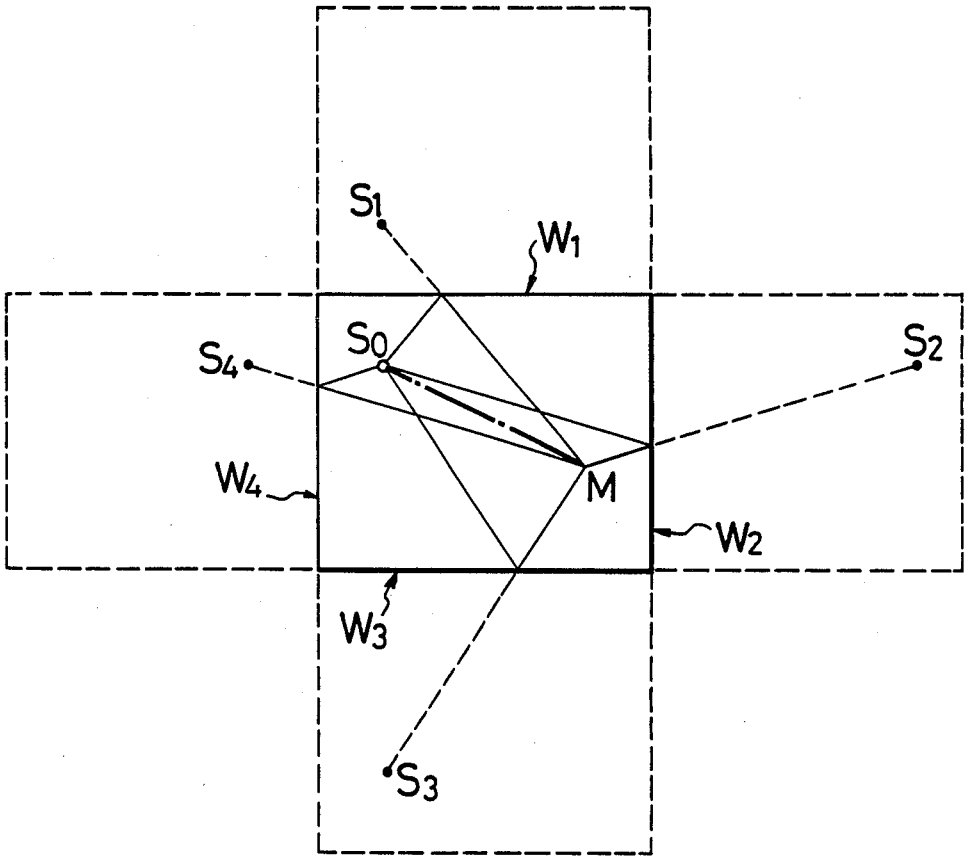
FIGS. 1 and 2 are respectively schematic views used to explain the fundamental theory of the present invention.

In FIG. 1, reference letters $W_1$, $W_2$, $W_3$ and $W_4$ designate four walls, respectively, which form a sound field surrounded thereby, $S_0$ a sound source and M a sound collecting point which are both located within the sound field surrounded by the four walls $W_1$ to $W_4$. In this case, it is assumed that the sound pressure caused by the sound which propagates along the direct path from the sound source $S_0$ to the sound collecting point M is taken as $P_0$, the sound pressure caused by a primary mirror image sound source $S_1$ generated by the wall $W_1$ as $P_1$, and the sound pressures similarly caused by primary mirror image sound sources $S_2$, $S_3$ and $S_4$ generated by the walls $W_2$, $W_3$ and $W_4$ as $P_2$, $P_3$ and $P_4$, respectively. Further, it is assumed that the sound pressures caused by the secondary mirror image sound sources, which are generated such that the sounds from the sound source $S_0$ are reflected on two walls, are respectively taken as $P_{12}$, $P_{13}$, $P_{14}$, $P_{21}$, $P_{23}$, $P_{24}$, $P_{31}$, $P_{32}$, $P_{34}$, $P_{41}$, $P_{42}$, and $P_{43}$. Similarly, it is assumed that the sound pressures caused by the mirror image sound sources, which are generated such that the sounds from the sound source $S_0$ are reflected on three walls and more, as $P_{ijk}$ . . . (where $i \neq j \neq k$ . . . ). Under such assumption, the ratio S/N at the sound collecting point M is expressed by the following equation (1)

$$S/N = \frac{P_0^2}{\sum_{i=1}^{4} P_i^2 + \sum_{i=1}^{4}\sum_{j=1}^{4} P_{ij}^2 + \sum_{i=1}^{4}\sum_{j=1}^{4}\sum_{k=1}^{4} P_{ijk}^2 + \dots} \quad (1)$$

where $i \neq j \neq k \neq \dots$.

Now, the ratio S/N is considered under the above condition when the sound collecting point M is located very close to or near the wall $W_2$. S/N represents the conventional signal to noise ratio.

The signal by the sound pressure $P_0$ directly reaching the sound collecting point M from the sound source $S_0$ is the same in phase as the signal by the sound pressure $P_2$ caused by the primary reflection on the wall $W_2$ over all frequencies, so that the above equation (1) becomes as follows:

$$S/N = \frac{P_0^2 + P_2^2}{P_1^2 + P_3^2 + P_4^2 + \sum_{i=1}^{4}\sum_{j=1}^{4} P_{ij}^2 + \sum_{i=1}^{4}\sum_{j=1}^{4}\sum_{k=1}^{4} P_{ijk}^2 + \dots} \quad (2)$$

where $i \neq j \neq k \neq \dots$.

At this time, since $P_0 \approx P_2$ is satisfied, the numerator of the equation (2) becomes $2P_0^2$. Further, since in general the denominators of the equations (1) and (2) are approximately equal to each other, it is understood that the ratio S/N is improved by about 3 dB.

Figure 2:
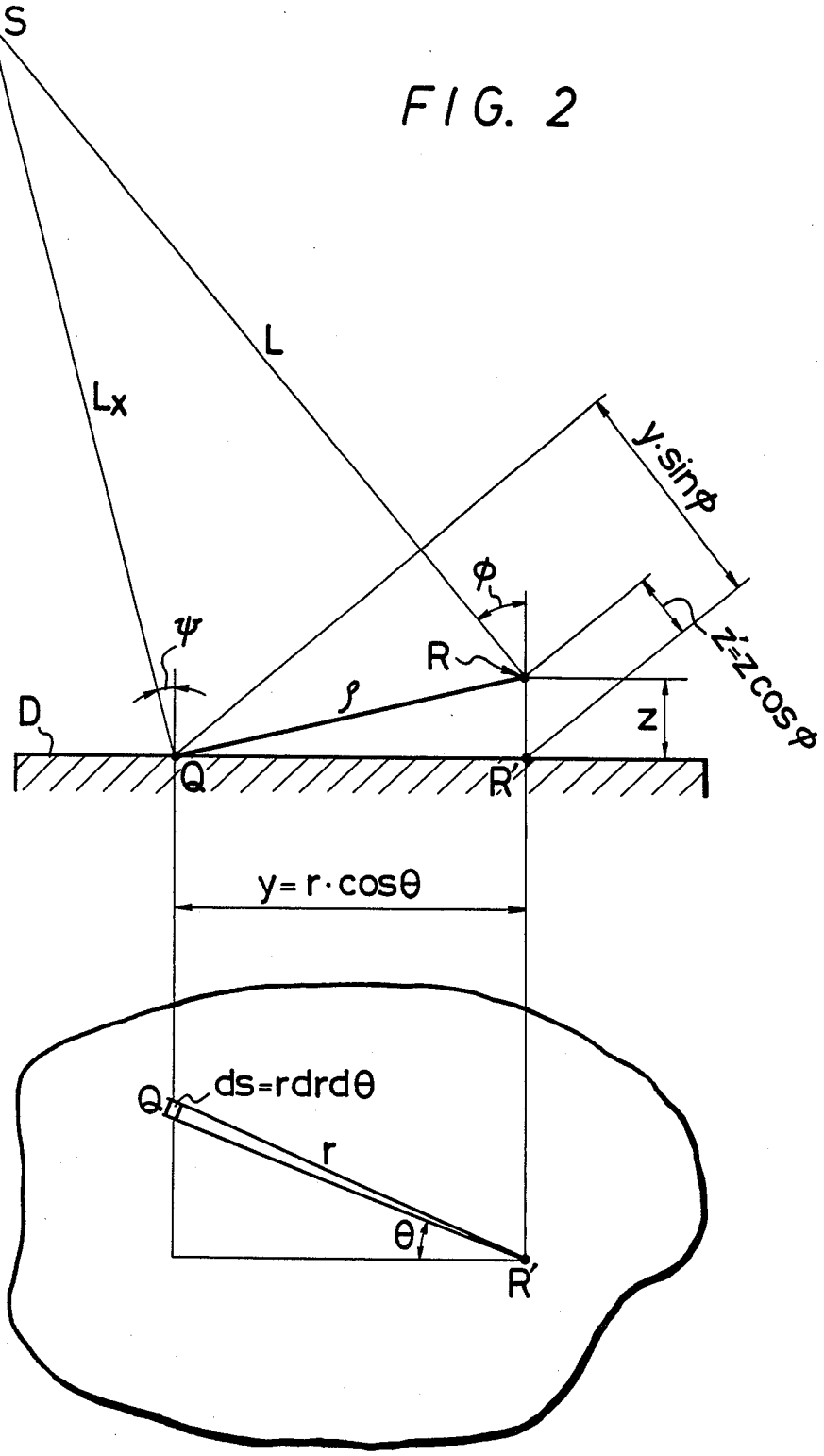

Next, such a case will be now considered where a sound source S is positioned in a free space, a disc D which will become an obstacle for the sound emitted from the sound source S is presented and a sound receiving point R is located above the surface of the disc D by a height Z as shown in FIG. 2.

In case of FIG. 2, a direct sound $\Phi_P$ through a direct path L from the sound source S to the sound receiving point R is expressed as follows:

$$\Phi_p = \frac{\Phi_0}{L} e^{-jkL} \tag{3}$$

A particle velocity U on a surface dS by the direct sound $\Phi_P$ is expressed as follows:

$$U = -\left(\frac{1}{L_x} + jk\right) \frac{\Phi_0}{L_x} e^{-jkL_x} \cdot \cos\Psi \tag{4}$$

and a reflected sound $d\Phi_S$ on the surface dS becomes as follows:

$$d\Phi_S = \frac{-U}{2\pi\rho} dS \cdot e^{-jk\rho} \tag{5}$$

Therefore, a sum $\Phi_S$ of the reflected sounds is expressed as follows:

$$\Phi_S = \int_0^{2\pi} \int_0^{A(\theta)} \frac{e^{-jk\rho}}{2\pi\rho}\left(\frac{1}{L_x} + jk\right) \frac{\Phi_0}{L_x} e^{-jkL_x} \cdot \cos\Psi \cdot r dr d\theta \tag{6}$$

Thus, if a sound pressure P at the sound receiving point R is expressed by the ratio for a sound pressure $P_p$ of the direct sound, its approximate equation becomes as follows:

$$\frac{P}{P_p} = \frac{\Phi}{\Phi_P} = \frac{\Phi_P + \Phi_S}{\Phi_P} \tag{7}$$

$$= 1 + \frac{L}{2\pi\Phi_0 e^{-jkL}} \int_0^{2\pi} \int_0^{A(\theta)} \left(\frac{1}{L_x} + jk\right) \frac{\Phi_0 e^{-jkL_x}}{L_x} \cdot e^{-jk\rho} \cdot \cos\Psi \frac{r dr d\theta}{\rho}$$

$$= 1 + \frac{L}{2\pi} e^{jkL} \int_0^{2\pi} \int_0^{AZ(\theta)} \frac{\cos\Psi}{L_x} e^{-jk(L_x+\rho)} \cdot \left(\frac{1}{L_x} + jk\right) d\rho d\theta$$

where $AZ(\theta) = \sqrt{\{A(\theta)\}^2 + Z^2}$ .

AZ ($\theta$) is a function of the form of the rigid boundary about the point R′ perpendicular to the rigid boundary from the sound receiving point R represented by polar coordinates. AZ ($\theta$) is therefore a function of A($\theta$) and Z.

The characteristics on the axis of a plane wave upon its coming ($\Psi=0$ and $L\rightarrow\infty$) or the characteristics on the center of the disc D with the radius a when the plane wave is directly incident on the disc D are expressed from the equation (7) as follows:

$$\frac{P}{P_p} = 1 + e^{-j2kz} - e^{-jk(z+a1)} \tag{8}$$

where $a_1 = \sqrt{a^2 + z^2}$ .

As a result, as expressed by the equation (8), the frequency characteristics at the center of the disc D include the ripple components of about 10 dB. The reason of this is by the fact that since the same boundary conditions are superimposed on one another, the interference by the diffraction becomes large. In order to reduce the ripple components, it is necessary to locate the sound receiving point R eccentric or apart from the center of the disc D. By this it is possible to smooth the frequency characteristic, but in accompany therewith the directional characteristic becomes out of symmetry and the directional characteristic appears in the direction opposite to that from which the sound receiving point is displaced. The reason of this is that the mirror image effect (reflection effect) is reduced in the direction near the edge of the disc D from the sound receiving point M as explained in connection with FIG. 1, the level of the directional characteristic becomes low but in the opposite direction the reflection surface which will cause the mirror effect will be large and the level of the directional characteristic increases.

The present invention is effected based on the fact that the directional characteristic appears in the opposite direction into which the sound receiving point is displaced.

Figure 3:
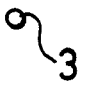
FIG. 3 is a perspective view showing an embodiment of the microphone apparatus according to the invention.
Figure 3:
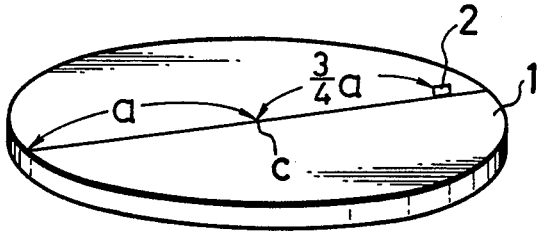

FIG. 3 shows an example of the microphone apparatus according to the present invention. In this example, a plain plate 1 with a predetermined shape and a constant area, for example, a disc with a radius a is located as a plain surface of a rigid body and a microphone element 2 is located on the disc 1 at its peripheral position which is different from a center c of the disc 1, for example, at the position apart from the center c by $\frac{3}{4}$a. In place of the disc, a plain plate such as a square shape plain plate, a rectangular shape plain plate or other shape plain plate can be used as the plain plate 1. A sound source 3 is located above the microphone element 2 on the plain plate 1 apart therefrom by a predetermined distance.

Figure 4A:
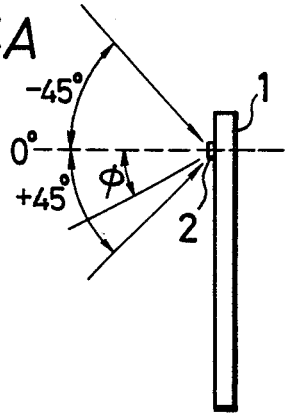
FIGS. 4A and 4B show a model used for explaining the operation of the embodiment shown in FIG. 3.
Figure 4B:
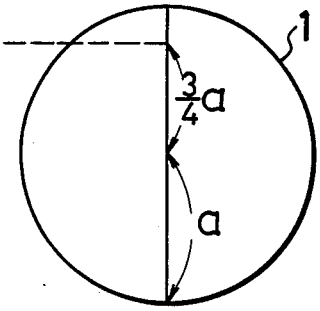
Figure 5:
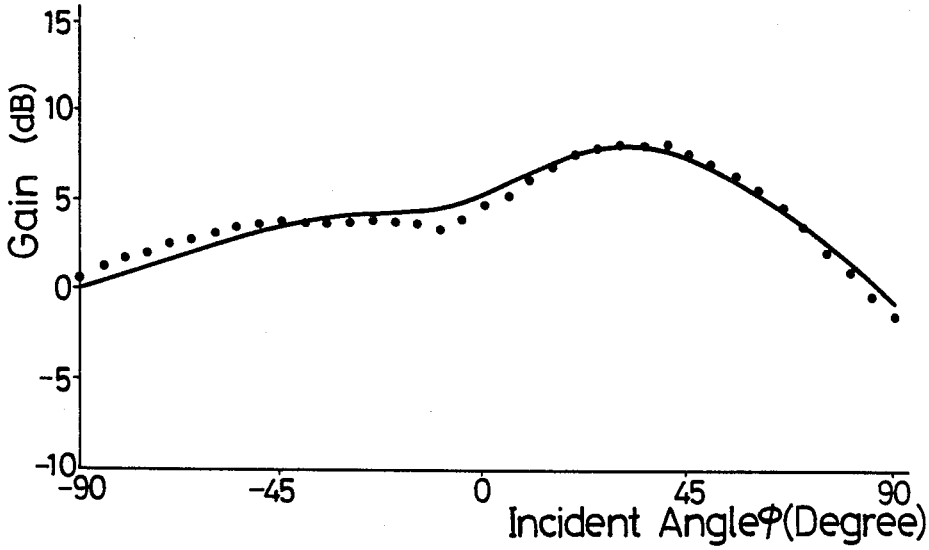
FIGS. 5 to 7 are respectively characteristic graphs used to explain the operation of the embodiment shown in FIG. 3.

FIG. 4A is a schematic side view of FIG. 3 and FIG. 4B is a schematic plan view of FIG. 3, respectively. In FIG. 4A, reference letter $\Phi$ designates the incident angle of the sound from the sound source 3 (shown in FIG. 3) on the microphone element 2. When the incident angle $\Phi$ is changed, the change in the sound pressure at the microphone element 2 by the sound source 3 reveals the directional characteristics indicated by the black points in the graph of FIG. 5 (practically measured values). The condition in this practical measurement is, for example, such that a=85 mm, $\frac{3}{4}$a$\approx$65 mm, and the distance between the sound source 3 and the plain plate 1 is about 2.5$\sim$3 m. In the graph of FIG. 5, the solid line curve shows the calculated value by an approximate analysis under which the diffracted sound through the side of the plain surface of the rigid body is neglected in view of practical point. It is understood from the graph of FIG. 5 that the measured values are substantially coincident with the calculated values. Further, from the graph of FIG. 5 it is understood that the collected sound pressure becomes high for the sound in a constant direction (from the position of the center direction) and minimum at the position of the plane flush with the plane of the plain plate 1. In this case, the sound from the sound source 3 is not a so-called burst-shape interrupted wave but a continuous wave with a constant frequency and a constant sound pressure.

Figure 6:
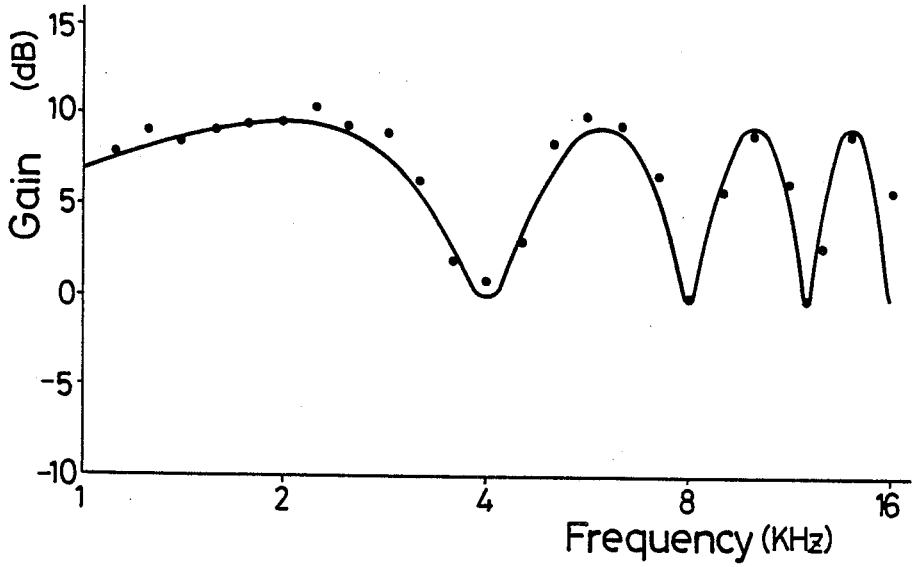

The gain of the collected sound pressure relative to the frequency is shown in the graph of FIG. 6 in which the solid line curve represents the calculated value while the black points denote measured values. From the graph of FIG. 6, it is understood that the gain of the collected sound pressure for the frequency is such that the ratio between its increase and decrease becomes large as the frequency becomes high.

Figure 7:
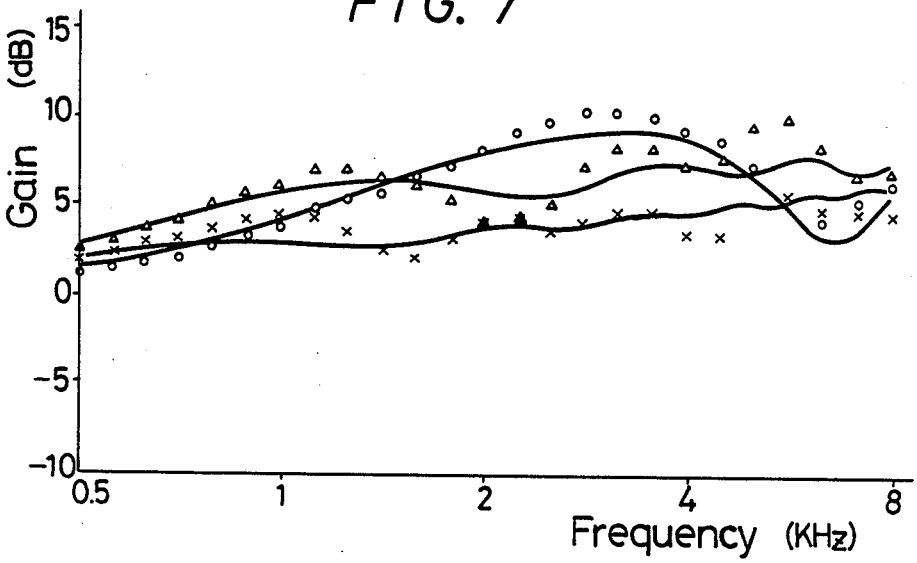

FIG. 7 is a graph showing the frequency characteristics or the relation of the directional characteristics to the frequency characteristics when as shown in FIG. 4 the incident angle $\Phi$ of the plane wave is set at $+45°$, $0°$ and $-45°$ under the same condition. In the graph of FIG. 7, the solid line curves represent the calculated values and the other marks represent the measured values. In this case, the mark $\times$ is the case where the incident angle $\Phi$ is selected as $+45°$, the mark $\Delta$ the case where the incident angle $\Phi$ as $0°$ and the mark $\bigcirc$ the case of the incident angle $\Phi$ as $-45°$, respectively. From the graph of FIG. 7 it will be clear that the relation between the directional characteristic of the collected sound and the frequency is such that the frequency characteristic of the sound appears more remarkable as the sound becomes near the radius direction of the plain plate 1 and the isolation between the left and the right is established over 800 Hz to 6 kHz which is important for the auditory sense.

As described above, according to the above example of the invention, by locating the microphone element 2 at the position apart from the center c of the plain plate 1 with a predetermined distance i.e. $\frac{3}{4}a$, the gain of the collected sound pressure becomes high as the sound comes nearer from the center c of the plain plate 1, the frequency characteristics there of becomes remarkable and the various characteristics such as sensitivity, clarity and so on thereof are improved.

Figure 8:
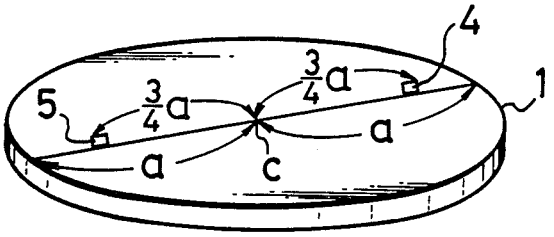
FIG. 8 is a perspective view showing another embodiment of the present invention.

FIG. 8 shows another example of the invention in which microphone elements 4 and 5 are respectively located at positions each apart from the center c of the plain plate 1 by $\frac{3}{4}a$ and symmetrical with respect to the center c. When the measuring condition of the microphone elements 4 and 5 are selected to be the same as that of the first example, this example represents the same characteristics.

Figure 9:
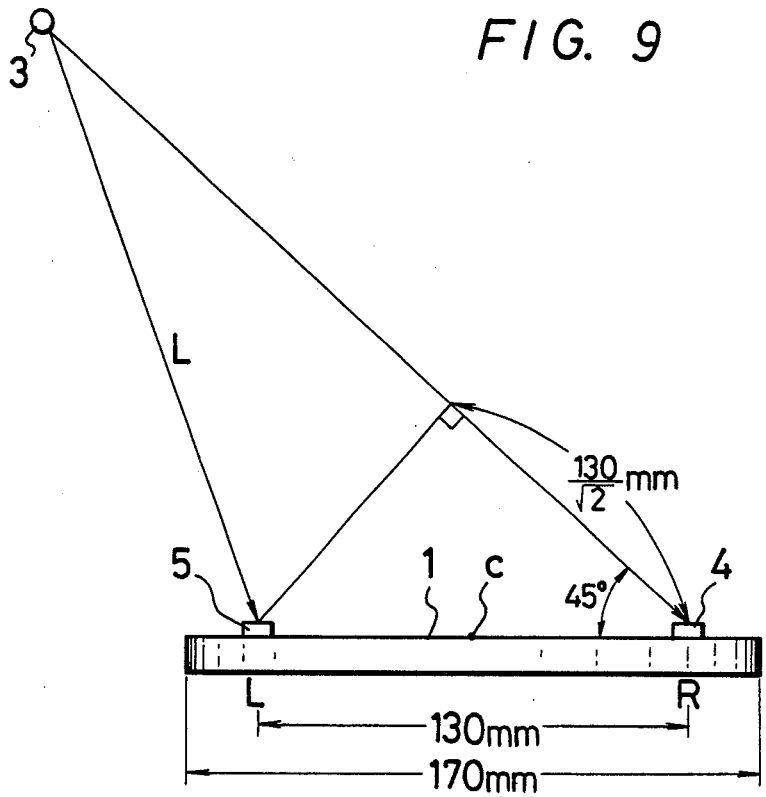
FIGS. 9 to 11 are respectively diagrams used for the explanation of the operation of the embodiment shown in FIG. 8.

Under the above conditions, now such case is considered that, as shown in FIG. 9, the radius a of the plain plate 1 is selected as 85 mm, the distances of the left (L) and right (R) microphone elements 4 and 5 from the center c of the plain plate 1 are each selected as 65 mm and the sound source 3 is positioned in the direction at the intersecting angle of about 45° to the right microphone element 4 and apart therefrom about 2.5~3 m. When the sound from the sound source 3 is a continuous wave with a constant frequency and a constant sound pressure, as described above the collected sound pressure at the right microphone element 4 is higher than that at the left microphone element 5. Thus, if the sounds from the respective microphone elements are recorded or heard as the left sound comes from the left side and the right sound comes from the right side, the sound is different from the location of FIG. 9 and the localization of the sound image is shifted to the right direction. Accordingly, when a continuous sound with a constant frequency and constant sound pressure is recorded by a recording apparatus such as a tape recorder and so on under the above stereo microphone system as mentioned above, it is necessary that the output from the left microphone element is supplied to the right input of the recording apparatus and the output from the right microphone element is supplied to the left input of the recording apparatus. In other words, in this case since the directivity is opposite to the setting position for the sound collection different from the prior art sound recording and reproducing, upon the recording and reproducing the localization is set opposite in the left and right positions.

Figure 10:
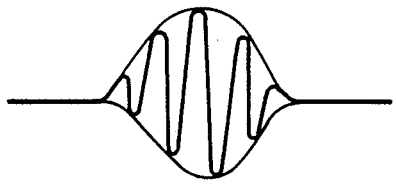
Figure 11:
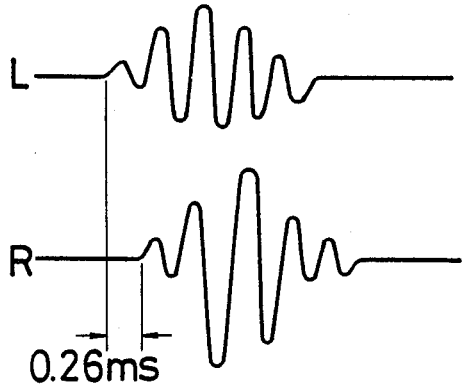

However, if the sound source 3 is made to generate an interrupted wave of a burst shape variable in frequency and different in sound pressure as shown in FIG. 10, the sound arriving at the right microphone element 4 is delayed by the distance amount of $$\frac{130}{\sqrt{2}}\ \text{mm}$$

from that arriving at the left microphone element 5 in time as shown in FIG. 9. In other words, the arriving time of the interrupted sound wave to the microphone element 4 is delayed by 0.26 ms from that to the microphone element 5 as shown in FIG. 11. Therefore, when the sound is heard by head phones or the like whose directivity is substantially determined by the phase difference of the arriving sounds, it is preferred that the output from the left microphone element is supplied to the left input and the output from the right microphone element is supplied to the right input. That is, when the interrupted sound wave is heard through the head phones and the like whose directivity is determined by the phase difference of the sounds, the localization (directional sense) by the auditory sense is sensed to the left side more. This is based on a so-called law of the first wavefront (Has's effect) that when the above time difference is less than about 5 ms, the localization moves to the side of the large level.

Accordingly, in case of using the head phones and so on set forth above, it is desired that similar to the normal recording mode, the output from the left microphone element is fed to the left input and the output from the right microphone element is fed to the right input, respectively. However, when a reproduced sound is heard through a speaker, a preceding sound becomes dull and the sense of the distance become opposite, so that similar to the stationary state of the sound with the constant frequency and the constant sound pressure, the left microphone element is connected to the right input and the right microphone element is connected to the left input.

As mentioned above, according to the second example of the present invention, the same operation and effect as those of the first example are achieved and further the stereophonic sound collection becomes possible by effectively utilizing the above sound field phenomenon.

Figure 12:
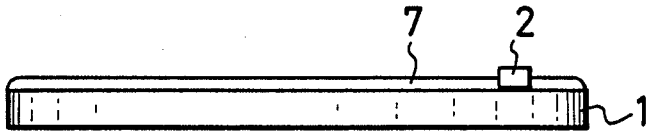
FIG. 12 is a side view showing a further embodiment of the invention.

FIG. 12 shows a further example of the present invention in which a cloth 7 with a constant thickness and sound absorbing characteristics is bonded to the surface of the plain plate 1 under the state similar to that shown in FIG. 3 while the sound absorbing surface of the microphone element 2 is exposed. The cloth 7 may be made of, for example, wool, glass wool, felt and so on.

Figure 13:
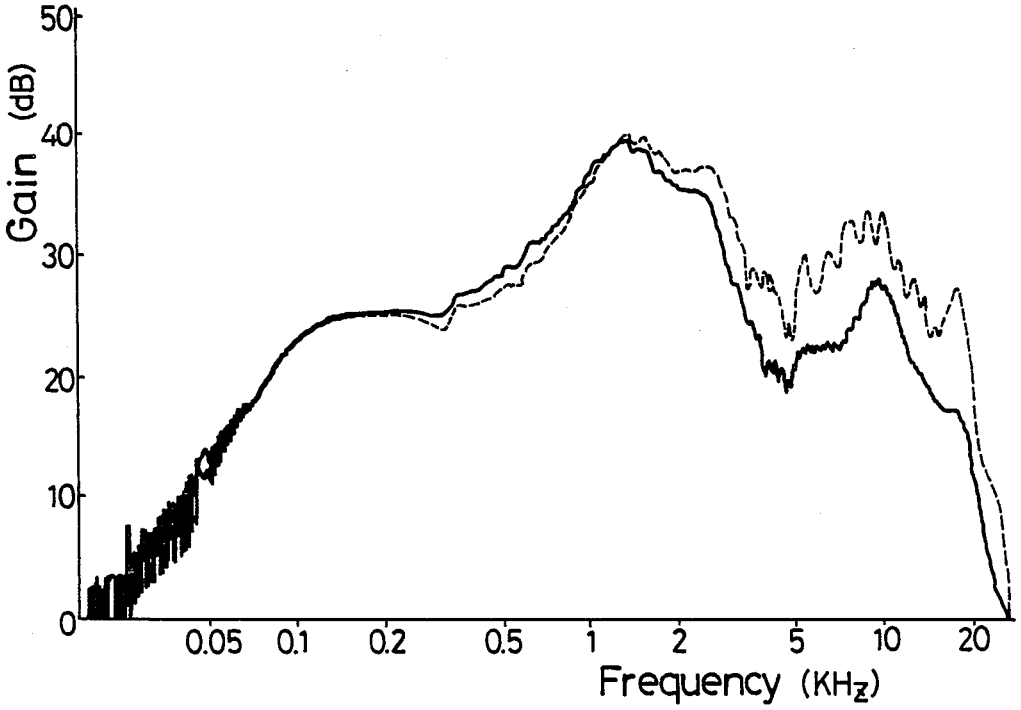
FIG. 13 is a characteristic graph used to explain the operation of the embodiment shown in FIG. 12.

FIG. 13 is a graph showing the frequency characteristics of the third example shown in FIG. 12. In the graph of FIG. 13, the broken line curve represents the frequency characteristics of the case where the cloth 7 is not provided and the solid line curve represents those with the cloth 7. From the graph of FIG. 13, it will be understood that the high frequency region higher than, for example, 5000 Hz of the frequency characteristics can be suppressed by the provision of the cloth 7.

Accordingly, if the third example or microphone apparatus of the invention shown in FIG. 12 is employed to record the sound in a conference or the like, sound components of relatively high frequencies generated from such as a shelf, desk, turning over the leaves and so on can be removed from being collected or unnecessary sounds other than voices and so on are not collected so that the conference can be recorded effectively. Further, the third example of the invention may be used under the stereophonic sound collection mode as shown in FIG. 8.

As described above, according to the present invention, since the microphone element is located on the plain plate with a constant area at its peripheral position at least different from its center, the sound collecting system which effectively utilizes the sound field near the plain surface of the rigid body can be presented.

Further, according to the present invention, the various characteristics such as sensitivity, clarity and so on can be improved as compared with the prior art microphone apparatus.

In addition, the high frequency region higher than about 1 kHz is raised by the invention so that the sense for the distance is substantially compressed to make the sound collection area wide and hence the microphone apparatus is very effective for use as a sound collection system to collect the sound in the conference and so on.

The above description is given on the single preferred embodiments of the invention, but it will be apparent that many modifications and variations could be effected by one skilled in the art without departing from the spirits or scope of the novel concepts of the invention, so that the scope of the invention should be determined by the appended claims only.

I claim as my invention:

1. A microphone apparatus comprising a rigid plate having a plain surface with a predetermined area, and a microphone element attached to said rigid plate so as to locate its sound receiving point at a peripheral position which is different from the center of said plate and a sound source spaced a vertical distance from said plain surface such that a sound pressure signal directly reaching said microphone element from said sound source has practically the same phase over the entire audible frequency band as signals caused by non-direct or reflecting waves on said plain surface, respectively at the sound receiving point of said microphone element.

2. A microphone apparatus as claimed in claim 1, wherein said rigid plate is a plain disc.

3. A microphone apparatus as claimed in claim 1, wherein said rigid plate is a plain square plate.

4. A microphone apparatus as claimed in claim 1, wherein said microphone element is located at a position apart from the center of said rigid plate by $\frac{3}{4}$ a where a is the radius or $\frac{1}{2}$ side of the rigid plate.

5. A microphone apparatus as claimed in claim 1, wherein said microphone element consists of a pair of microphone elements which are located at symmetrical positions apart from the center of said rigid plate by $\frac{3}{4}$ a where a is the radius or $\frac{1}{2}$ side of said rigid plate.

6. A microphone apparatus as claimed in claim 1 further comprising a sound absorbing member of a constant thickness on said rigid plate.

* * * * *